US006670584B1

(12) United States Patent
Azizeh

(10) Patent No.: US 6,670,584 B1
(45) Date of Patent: Dec. 30, 2003

(54) SPA ELECTRIC HEATER SYSTEM USING MULTIPLE SPA HEATERS

(76) Inventor: Kareem I. Azizeh, 701 W. Foothill Blvd., Azusa, CA (US) 91702

( * ) Notice: Subject to any disclaimer, the term of this patent is extended or adjusted under 35 U.S.C. 154(b) by 41 days.

(21) Appl. No.: 10/119,108

(22) Filed: Apr. 10, 2002

(51) Int. Cl.[7] ..... F24H 1/00

(52) U.S. Cl. ..... 219/485; 219/497; 392/449; 307/39; 4/493

(58) Field of Search ..... 219/485, 483, 219/501, 497, 486; 4/493; 392/441, 449; 307/39, 41

(56) References Cited

U.S. PATENT DOCUMENTS

| | | | | |
|---|---|---|---|---|
| 2,843,759 A | * | 7/1958 | Roots | 219/486 |
| 3,005,109 A | * | 10/1961 | Funkhouser et al. | 219/485 |
| 4,160,153 A | * | 7/1979 | Melander | 219/485 |
| 5,361,215 A | | 11/1994 | Tompkins et al. | |
| 6,157,008 A | * | 12/2000 | Brown et al. | 219/486 |
| 6,476,363 B1 | * | 11/2002 | Authier et al. | 219/481 |
| 6,559,426 B2 | * | 5/2003 | Jirmann | 219/480 |

FOREIGN PATENT DOCUMENTS

| | | |
|---|---|---|
| FR | 2566610 | * 12/1985 |
| WO | 95/29572 | * 11/1995 |

* cited by examiner

*Primary Examiner*—John A. Jeffery
(74) *Attorney, Agent, or Firm*—Edgar W. Averill, Jr.

(57) ABSTRACT

A process of electrically heating a spa having electrically operated devices connected to the spa, such as one or more water pumps, lights, and at least two heaters, in an environment in which there is not enough current to operate all spa devices simultaneously. The process includes the steps of providing a control system with data as to which devices are connected to the spa and how much current each device requires, and how much current is available to the spa. Next, the amount of current that is being used by the devices currently operating, other than the two heaters, is calculated. This provides the amount of the residual current available. If the spa water temperature is below a desired temperature, a determination is made as to whether there is enough current to operate one or both spa heaters and either one heater or both heaters are turned on based upon this calculation.

5 Claims, 2 Drawing Sheets

ROUTINE TO CALCULATE TOTAL CONSUMED CURRENT BASED ON ACTIVATED DEVICES IN THE SYSTEM

ROUTINE TO CALCULATE TOTAL CONSUMED CURRENT BASED ON ACTIVATED DEVICES IN THE SYSTEM

SPA ELECTRIC HEATER SYSTEM USING MULTIPLE SPA HEATERS

BACKGROUND OF THE INVENTION

The field of the invention is spa controllers and the invention relates more particularly to the control of heaters for spas. Most electrically heated spas are equipped with an electric heating element that is nominally rated at 6 kw, at 240 volts. This same heater is rated at 1.5 kw at 120 volts. A typical spa installation operating at 240 volts requires a 50 amp service to provide enough current to operate the heater and the water and air pumps in the spa. The following table summarizes the current consumption in a typical spa with a heater, a dual speed water pump and an air blower:

| | Current Draw Amps | |
|---|---|---|
| | Low Range | High Range |
| Heater | 22 | 25 |
| Low pump | 2 | 3 |
| High pump | 6 | 15 |
| Air Blower | 5 | 8 |

Innovations in the spa industry have made it necessary to add a second and even a third water pump. Such additions require more current and, in order to stay within the limitations of the available current, it has become necessary for the spa heater to be turned off when the pumps are operating. With the heater turned off, the spa cools down and a user must turn off one or more pumps in order for the spa to reheat again.

In order to stay within the available current limitations, because of the limitations of the driving relays, some spas may be equipped with heaters that have lower wattage ratings. 4 kw and even 3 kw heaters are not uncommon in the spa industry. For larger or commercial institutions, an 11 kw heater is often used. This heater requires at least a 50 amp supply service just for operating the heater alone.

Modern spas typically utilize electronic controls. One such control system is shown in U.S. Pat. No. 5,361,215. Such systems, however, typically turn off the single spa heater when there is insufficient supply service. Alternatively, low kilowatt rated heaters are used which slow the initial heating of the spa.

BRIEF SUMMARY OF THE INVENTION

It is an object of the present invention to provide a spa heating system which permits faster initial heating of the spa, as well as faster heat recovery under use, especially in colder weather.

It is another object of the present invention to provide a spa control system which permits heating while the spa is being used without the need for higher available current with its concomitant requirement for larger supply wire size and increase of power service to the residence.

The present invention is for a process for electrically heating a spa having electrically operated devices connected thereto, such as one or more water and/or air pumps, lights, and at least two heaters in an environment in which there is sufficient current available to operate all spa devices simultaneously. The process includes the steps of providing a control system with data as to which devices are connected to the spa and how much current each device requires, as well as the amount of current available to the spa. Next, the amount of current being used by devices other than the two heaters is calculated and subtracted from the available current to provide the value of residual current. If the spa water is in need of heating, a determination is made as to whether there is enough current available to operate one heater or both heaters, and the control system activates one or both heaters, based upon the results of this calculation.

DESCRIPTION OF THE PREFERRED EMBODIMENTS

Residences are typically not wired with the installation of a spa in mind. Most spas are purchased for use in established residences, where the typical service panel is rated at 200 amps. If the spa is plugged into an electrical outlet, the maximum amperage is 20 amps, and only 80% of this is available. Spas which are directly hot wired to the panel are limited by the service panel and if wired at 240 volts, a 50 amp service is used to provide enough current to operate the heater and the water and air pumps. As show above, 50 amps is not sufficient to operate many heaters with the high pump and air blower operating. As the result, most spa controllers turn the heater off when the high pumps and air blowers are operating so that the system limits are not exceeded. Alternatively, low wattage heaters are used which require a long time to reach the initial desired temperature. Also, particularly in cold climates, the spa cools down during use when the heater is not turned on.

The present invention eliminates these problems by providing two independently controlled heaters and providing a control system which is capable of operating just one heater when the other devices utilize too much current to operate both heaters. For instance, a 3 kw heater and an independently operated 6 kw heater may be both installed in a spa and operated under the control of a micro-processor which is programmed with data as to which devices are connected to the spa and how much current each device requires. The micro-processor is also programmed with how much current is available to the spa. During operation of the spa, a routine is run to determine which devices are being used, adding the amount of current used by these devices, and calculating a value of residual current. Then, depending upon the value of residual current, either one or both heaters are activated. The micro-processor can receive data from the spa user as to the amount of current used by all of the devices and by the spa assembly.

Figure 1:
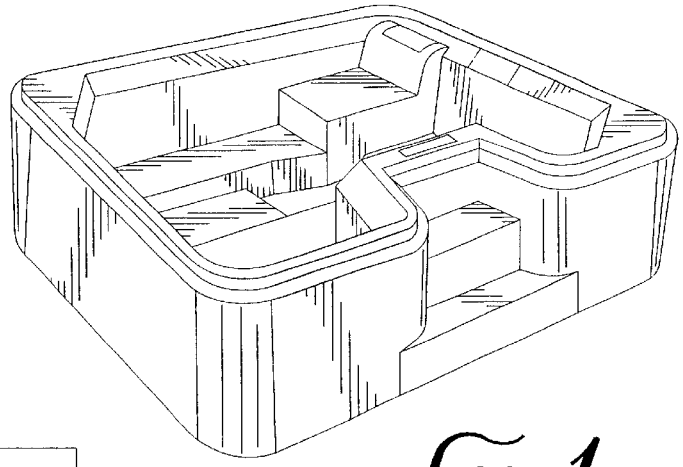
FIG. 1 is a flow chart of the spa control system of the present invention.

A preferred routine is shown in FIG. 1 of the drawings. When the spa is initially turned on at the start, both heaters are deactivated as shown at reference character 11. The desired temperature of the spa is entered by the user and the actual temperature of the spa water is determined by a temperature sensor in the spa water. If the desired temperature is above the actual temperature, a determination is made at 12 as to whether or not heat is needed. If heat is needed, a calculation is made as to the amount of current being consumed by box 13.

Figure 2:
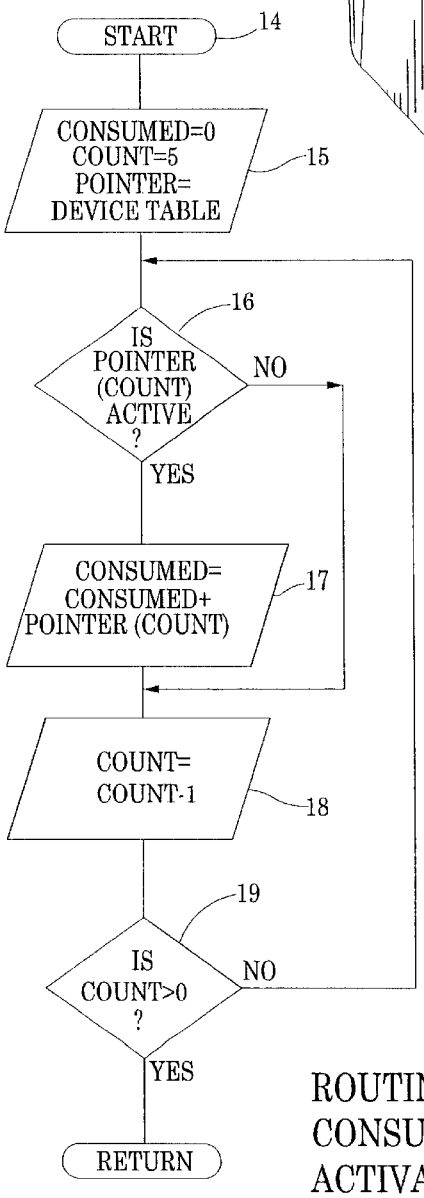
FIG. 2 is a flow chart of the steps used to calculate total consumed current, based on the activated devices in the system.
Figure 3:
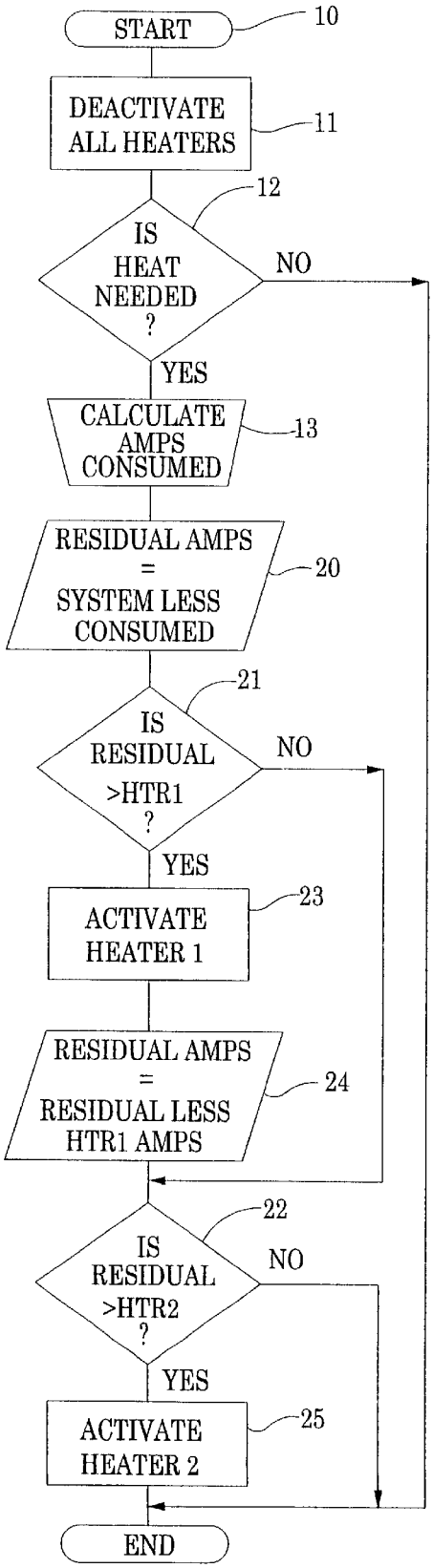
FIG. 3 is a flow chart of the routine to calculate total consumed current.

One system which makes such calculation is shown in FIG. 2. This program is initiated at 14 where the value for consumed amps is set at 0, count is set at 5, and the device table contains the five devices connected to the spa, each set to a different pointer number. As shown in step 16, the program determines whether pointer number 5 (for instance, pump number 1) is active. If it is, the programmed number of amps utilized by pump number 1 is set to equal the consumed number of amps, as shown at 17, and the count is reduced from 5 to 4, as shown at 18. Since the count is not 0, the routine returns to step number 16, which determines whether device number 4 is active. If so, the preprogrammed amount of current utilized by device number 4 is added to the value previously calculated for consumed amps at 17 and the count is reduced from 4 to 3. At this point, since the count is not 0, the program returns to step 16 where the next device is queried. This loop continues until the count is 0, at which point the consumed current is ascertained.

Returning to step 20 in FIG. 1, the residual amps are calculated by subtracting the consumed amps from the preprogrammed system amps. It should be noted that the system amps for a 20 amp system is 16 amps, and thus, system amps does not mean the total amps of the system, but the amps actually available to the system.

Next, as shown at 21, a determination is made whether the residual amps calculated at 20 is greater than the amps required for heater number 1. If it is not, the program questions whether the residual amps are sufficient to operate heater number 2, as shown at 22. If it is not, then heater number 2 is not activated. If any of the devices are turned on or off, the calculation of FIG. 2 is repeated, as is the flow chart of FIG. 1. If the residual amps are greater than that required by heater number 1, heater number 1 is activated, as shown at 23, and a second calculation is made by reducing the residual amps by the amount of amps used by heater number 1, as shown at 24, then the decision at box 22 is again made, and if there is sufficient residual amps, heater number 2 is activated, as shown at 23, or if not, heater number 2 is not activated.

It is preferable that heater number 1 and heater number 2 utilize different amperage, although this is not essential. Preferably, heater number 1 would use 6 kw and heater number 2 would use 3 kw. Thus, the larger heater is initially turned on if possible, and if this is not possible, the smaller heater only is turned on. Conversely, if there is sufficient amps, both heaters are turned on.

In this way, the initial startup heating time is reduced and the heater is operated while the spa is being used. Because of this, it is often unnecessary to provide higher available current to a spa, since it can be carried out under conditions which heretofore would have caused the heater to be turned off.

While two heaters are discussed above, it is, of course, possible that three heaters could be used to provide even more fine tuning of the heating process, although two heaters are preferred.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A process for electrically heating a spa having electrically operated devices connected thereto such as one or more water pumps, lights and at least two heaters, in an environment in which there is insufficient current to operate all spa devices simultaneously comprising:

providing a microprocessor with data as to which devices are connected to the spa and how much current each device requires and how much current is available to the spa;

calculating the amount of current that is being used by devices other than said at least two heaters and determining a value of residual current;

if the spa water is below a set desired temperature, determining if there is enough current to operate one or both heaters and activating one or both heaters based upon the residual current.

2. The process of claim 1 wherein a user manually inputs the amperage used by said devices.

3. The process for electrically heating a spa of claim 2 wherein heater number two uses 3 KW.

4. The process for electrically heating a spa of claim 1 wherein heater number one uses 6 KW.

5. A process for electrically heating a spa having electrically operated devices connected thereto, such as one or more water pumps, lights, a heater, in an environment in which there is insufficient current to operate all spa devices simultaneously comprising:

providing at least two individually controllable electrical heaters to said spa comprising at least a heater number one and a heater number two;

determining the individual devices attached to said spa including said at least two electrical heaters;

determining the amount of current available to the spa;

determining the amount of current utilized by each of said individual devices and storing information regarding each device and the amount of current used by each device, and the amount of current available to the spa in the memory of a microprocessor;

initially deactivating all spa heaters;

ascertaining if spa water is below a desired set temperature and if so:

determining which devices are activated and calculating the amount of current being used;

subtracting the amount of current being used from the current available to the spa to arrive at a residual current available;

determining if the residual current available is greater than the current used by heater number one:

if the residual current available is greater than the current used by heater number one, activating heater number one;

subtracting the amount of current used by heater number one from the residual current to arrive at a first reduced residual current;

determining if the first reduced residual current is greater than the current used by heater number two;

if the first reduced residual current is greater than the current used by heater number two, activating heater number two and returning to said ascertaining step;

if the first reduced residual current is not greater than the current used by heater number two, return to said ascertaining step; and if the residual current available is not greater than the current used by heater number one, determining if the residual current available is greater than the current used by heater number two and, if so, activating heater number two and if not, return to said ascertaining step.

* * * * *